US005622384A

United States Patent [19]

Bradley

[11] Patent Number: 5,622,384

[45] Date of Patent: Apr. 22, 1997

[54] FOLDABLE DIE CUT CARDS

[75] Inventor: Sterling E. L. Bradley, N. Olmsted, Ohio

[73] Assignee: American Greetings Corporation, Cleveland, Ohio

[21] Appl. No.: 341,415

[22] Filed: Nov. 17, 1994

[51] Int. Cl.[6] ..... B42D 15/02

[52] U.S. Cl. ..... 281/2; 281/5; 281/51; 283/117; 40/124.12

[58] Field of Search ..... 283/117; 40/124.1; 281/2, 51, 5

[56] References Cited

U.S. PATENT DOCUMENTS

| | | |
|---|---|---|
| 286,642 | 10/1883 | Schwartz . |
| 930,108 | 8/1909 | Walcutt . |
| 1,311,733 | 7/1919 | Wilmot . |
| 2,205,262 | 6/1940 | Hayes . |
| 2,473,352 | 6/1949 | Zimmerman . |
| 2,696,690 | 12/1954 | Kellerer, née Bender . |
| 3,547,342 | 12/1970 | Smith . |
| 3,713,673 | 1/1973 | Katz . |
| 3,995,388 | 12/1976 | Penick et al. . |
| 4,084,015 | 4/1978 | Patterson . |
| 4,087,576 | 5/1978 | Patterson . |
| 4,531,319 | 7/1985 | Saxton . |
| 4,558,980 | 12/1985 | Sturdivan . |
| 4,613,157 | 9/1986 | Drabish . |
| 4,826,211 | 5/1989 | Sinnott et al. . |
| 4,828,105 | 5/1989 | Silengo et al. . |
| 4,833,802 | 5/1989 | Volkert . |
| 4,907,824 | 3/1990 | Smirnoff . |
| 5,076,611 | 12/1991 | Bouton . |
| 5,096,751 | 3/1992 | Duckek . |
| 5,117,569 | 6/1992 | Bean . |
| 5,133,496 | 7/1992 | Davidson et al. . |

*Primary Examiner*—Frances Han
*Attorney, Agent, or Firm*—Calfee Halter & Griswold

[57] ABSTRACT

A foldable card and method of making has multiple panels connected by fold lines which are placed laterally inward from free peripheral edges of end panels such that the card can be die cut in a folded configuration around an entire periphery of the card without entirely eliminating the fold lines. In a preferred method of making the cards, card stock is folded along the fold lines prior to cutting. The fold lines of the card are spaced at intervals to define different widths of adjoining panels so that when folded in a "Z" configuration a free peripheral edge of an end panel overlaps or underlaps a fold line. There may be multiple fold line interconnected panels between end panels. The fold lines may be oriented generally vertically or generally horizontally relative to the face of the card. Abutting surfaces of two or more adjacent panels may be bonded by adhesive at areas not coincident with adjoining fold lines in which case the fold lines between such adhesively connected panels may be eliminated in the die cutting step. In an alternate embodiment, a separate tipped-on panel is applied to a face of a folding panel of the card. The peripheral edges of the tipped-on panel are die cut such that the fold lines are positioned laterally inward from peripheral edges of the tipped-on panel so that the fold lines are not eliminated in the cutting step.

13 Claims, 4 Drawing Sheets

FOLDABLE DIE CUT CARDS

FIELD OF THE INVENTION

The present invention pertains in general to foldable greeting cards and, in particular, to foldable greeting cards formed from a single sheet of card stock and having multiple panels, and to cards having at least one panel which is structurally or materially different from other panels of the card.

BACKGROUND OF THE INVENTION

Foldable greeting cards having multiple panels connected by fold lines are desirable for the large amount of graphic area provided and structural distinctiveness. Large scale manufacture of such cards is difficult in processes in which the fold lines which connect the panels are formed after the card is cut from card stock. Automated folding is difficult with cards having non-linear peripheral edges to the panels. This is why folding cards are generally rectangular and the fold lines extend the entire length of the panels.

To form multiple panel cards with panels having curved and/or intricately shaped peripheral edges, it is preferred to die cut around an entire periphery (360°) of the front and back panels of the card while the card is in a folded configuration. This, however, results in cutting off the fold lines and thereby disconnecting the panels. U.S. Pat. No. 4,558,980 discloses a method of 360° die cutting a multi-panel card in a folded configuration wherein the fold lines are cut off and the panels remain connected by adhesive applied proximate to common peripheral edges of adjoining panels at areas coincident with the fold lines.

It is also desirable to 360° die cut cards which have a uniquely finished or textured cover panel which is adhesively attached or "tipped-on" to a folding panel of the card, whereby an entire periphery of the front panel could be intricately shaped, along with the other panels of the card. However, a similar problem arises in which the die cutting eliminates the fold line which connects the foldable panels, including the panel which supports the tipped-on panel. These constraints of prior approaches to foldable multi-panel cards increase production costs and thereby limit the number of card designs of this type available.

BRIEF SUMMARY OF THE INVENTION

The present invention provides a novel multi-panel card and method of making wherein panels of the card are die cut about an entire periphery of the card without eliminating fold lines which connect the panels.

In accordance with one aspect of the invention, a multi-panel foldable card and method of making includes end panels and at least one intermediate panel connected along generally parallel fold lines spaced at intervals relative to free peripheral edges of the end panels to be positioned laterally inward from the free peripheral edges when the card is in a fully folded configuration so that the free peripheral edges of the end panels extend at least partially beyond the fold lines, whereby the card in a fully folded configuration can be die cut about its periphery without eliminating the fold lines along which the panels are connected.

In accordance with another aspect of the invention, a card and method of making includes a tipped-on panel, separate from a foldable multi-panel portion of the card, adhesively attached to an end panel of the multi-panel portion of the card, wherein the tipped-on panel is dimensioned and adhesively attached relative to the multi-panel portion of the card such that an entire periphery of the tipped-on panel can be die cut along with portions of the periphery of the multi-panel portion when in a folded configuration without eliminating fold lines which connect panels of the multi-panel portion of the card.

These and other aspects of the invention will be apparent upon reading and understanding the following detailed description made with reference to the accompanying Figures wherein like reference numerals refer to like elements.

DETAILED DESCRIPTION OF PREFERRED EMBODIMENTS

Figure 1:
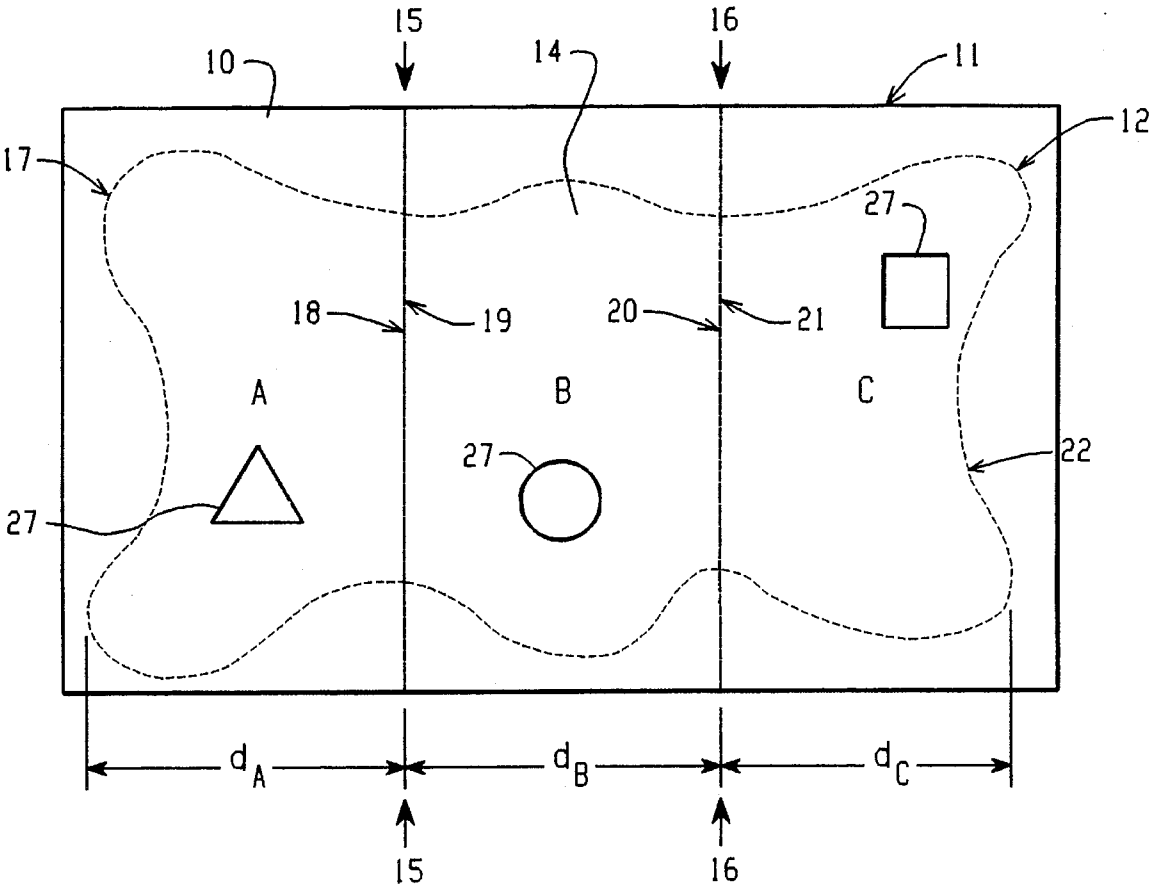
FIG. 1 is a plan view of a sheet of card stock having an outline of a card of the present invention.

FIG. 1 illustrates a sheet 10 of paper stock suitable for formation into a greeting card, such as for example eighty pound paper, having generally straight boundary edges 11, and a cutting outline 12 which defines peripheral edges of a multi-panel foldable card 14 to be cut from sheet 10 in, for example, a die cutting operation. The outline 12 includes generally rectilinear and parallel fold lines 15 and 16 which, along with peripheral cutting line 12, define in this example three panels, A, B, and C. As will be apparent, other configurations of peripheral cutting line 12 may be combined with two or more generally rectilinear parallel fold lines to produce multi-panel foldable cards of differing configurations within the scope of the invention.

In a preferred method of making cards of the present invention, sheet 10 is folded along fold lines 15 and 16 prior to cutting card 14 from sheet 10 along peripheral cutting outline 12. By this approach, sheet 10, having straight edges on all sides, is much more easily handled and folded by high speed folding equipment than a pre-cut card having complex peripheral edges. Furthermore, the 360° die cutting step of the method of the invention about an entire periphery of the card in a folded state includes of at least portions of the fold lines. When manufactured by this method, the finished cards are all pre-folded so that the end user is not required to crease the card along one or more fold lines.

Once card 14 is cut from sheet 10, panel A becomes an end panel having a free peripheral edge 17 which is not connected to a fold line, and an opposite lateral edge 18 connected at fold line 15 to panel B. Panel B is an intermediate panel having lateral edges 19 and 20 connected to fold lines 15 and 16 respectively. Panel C is an end panel having a lateral edge 21 connected at fold line 16 to panel B and a free peripheral edge 22 not connected to a fold line.

Figure 2:
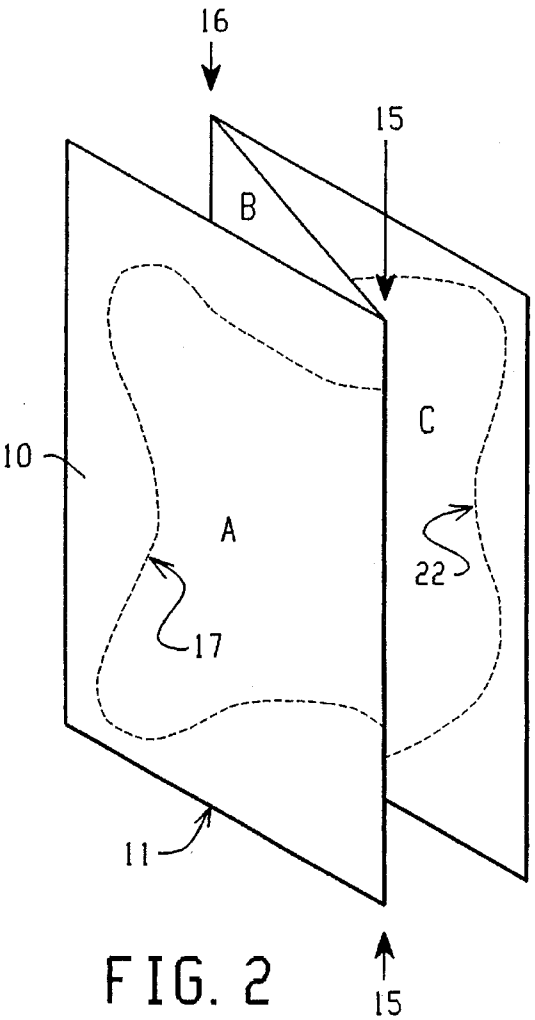
FIG. 2 is a perspective view of the sheet of FIG. 1 in a partially folded configuration.
Figure 3:
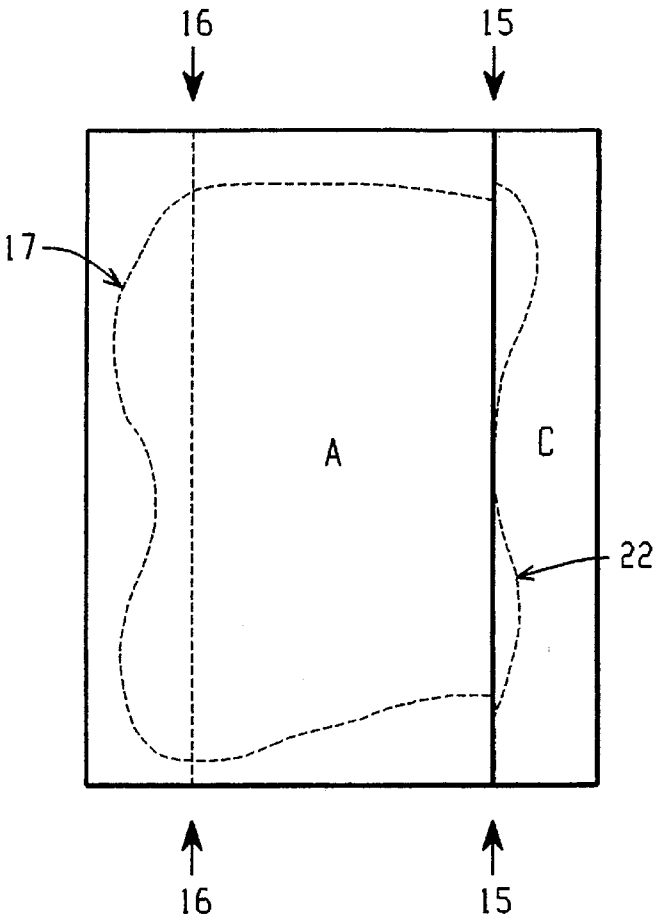
FIG. 3 is a plan view of the sheet of FIG. 2 in a fully folded configuration.

A distance $d_A$ measured from, for example, free peripheral edge 17 to lateral edge 18 of panel A perpendicular to fold line 15 represents a width of panel A. Similarly, a distance $d_B$ measured perpendicularly between fold lines 15 and 16 represents a width of panel B. And a distance $d_c$ measured perpendicularly from fold line 16 to free peripheral edge 22 represents a width of panel C. In this embodiment, by virtue of the relative lateral spacing of fold lines 15 and 16 and free peripheral edges 17 and 22, the width $d_B$ of panel B is less than the respective widths $d_A$ and $d_C$ of end panels A and C. As a result of this difference in the widths of the adjacent panels, when the card is folded in the manner shown in FIG. 2 (in a "Z" configuration), free peripheral edge 17 of panel A overlaps or extends laterally beyond fold line 16 connecting panels B and C, and free peripheral edge 22 of panel C extends laterally beyond and underlaps fold line 15 when the card is in the fully folded configuration shown in FIG. 3. In other words, when in the fully folded configuration, fold lines 15 and 16 lie laterally inward front free peripheral edges 17 and 22. This "short-folding" of the card allows all panels of the card to be peripherally die cut 360° at cutting outline 12 without entirely eliminating fold lines 15 and 16. The placement of fold lines 15 and 16 laterally inward to the peripheral edges of the card allows cutting outline 12 to be of any configuration which leaves a structurally sufficient amount of the fold lines intact. Of course, the same folding and cutting may be applied to card or paper stock which is "French folded" into a double thickness with a fold line across a top edge of the card.

Figure 4:
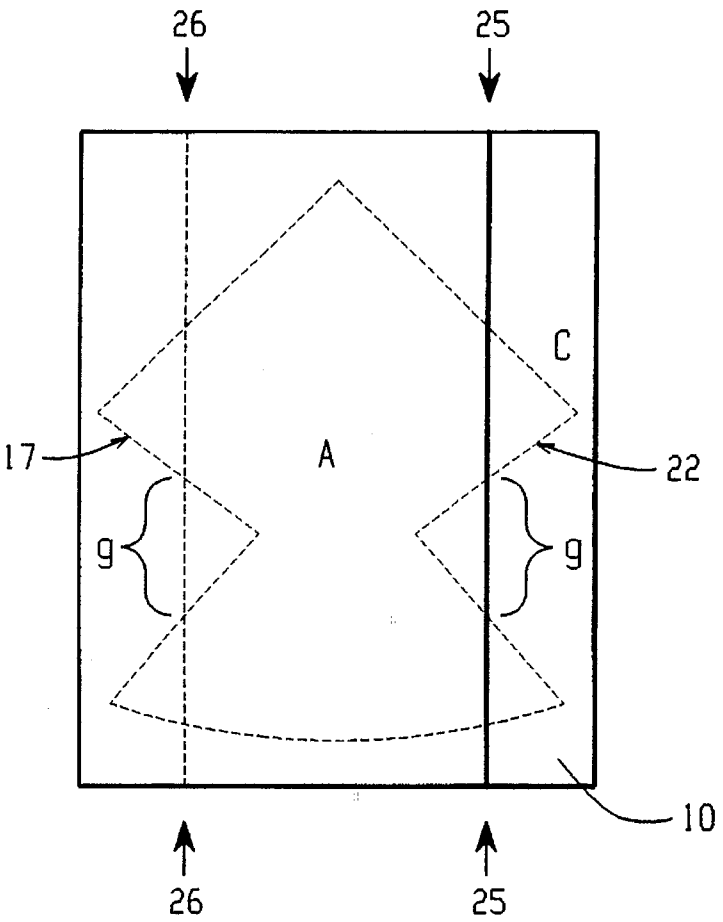
FIG. 4 is a plan view of card stock in a folded configuration in an alternate embodiment of the present invention.

FIG. 4 illustrates an example of another embodiment in which cutting outline 12 crosses over and eliminates portions g of fold gap-jumping fold lines 25 and 26 without detaching the connected panels or compromising the structural integrity of the fold connection of the panels. The exposure of free peripheral edge 22 of panel C adjacent fold line 15 allows the card to be easily opened (unfolded) by grasping one or both free peripheral edges 17, 22.

Figure 5:
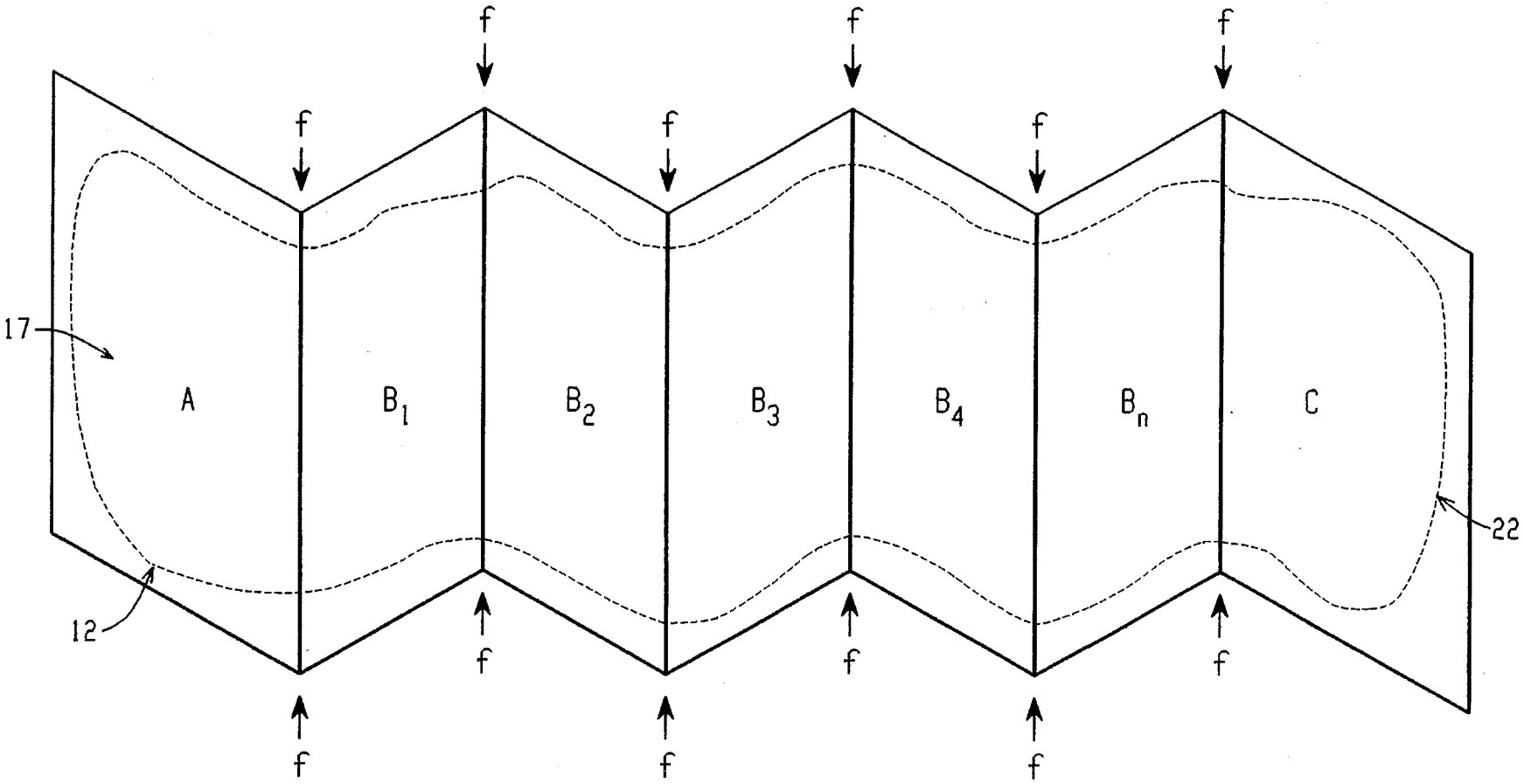
FIG. 5 is a perspective view of a partially folded card of an alternate embodiment of the present invention.

As shown in FIG. 5, there may be multiple intermediate panels $B_{1,2,3...}$ connected by multiple parallel fold lines f positioned to lie laterally inward from free peripheral edge 17 and extend laterally beyond free peripheral edge 22 when in a fully folded configuration.

Figure 6:
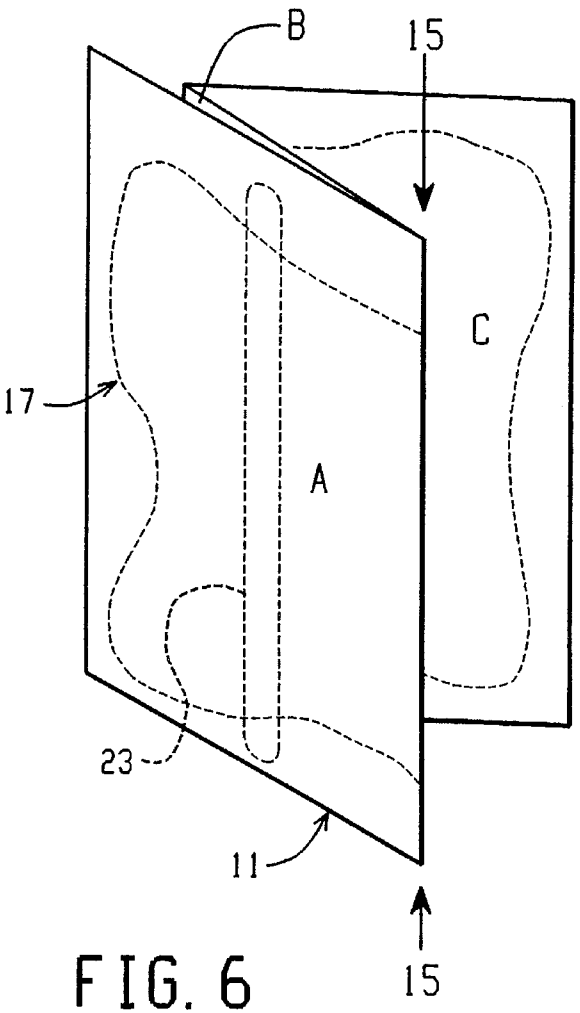
FIG. 6 is a perspective view of an alternate embodiment of the present invention in a partially folded configuration.

FIG. 6 illustrates an alternate embodiment in which abutting surfaces of panels A and B are glued or otherwise adhesively attached, for example along a glue line 23, at an area removed from and not coincident with fold line 15, thereby forming a cover having a thickness twice that of panel C. This embodiment may be employed in the instance where embossing or debossing is performed upon, for example, panel A prior to cutting and folding. The adhesive attachment of panel B to the back of panel A covers the negative impressions of embossing/debossing in panel A. Sheet 11 can be similarly die cut after folding and gluing of panel A to panel B. Because panels A and B are adhesively attached, fold line 15 may be completely eliminated wherein the edges of panels A and B adjacent fold line 15 are cut flush with free peripheral edge 22 of panel C. This method of manufacture eliminates the need to separately handle and position panel A for adhesive attachment to panels B and C.

Figure 7:
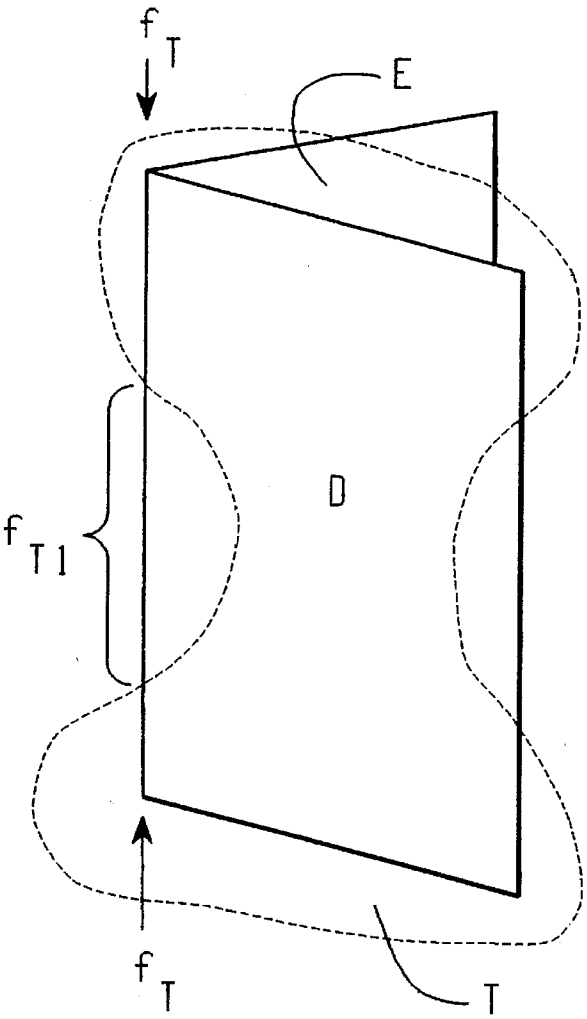
FIG. 7 is a perspective view of an alternate embodiment of the present invention in a partially folded configuration.

FIG. 7 illustrates another embodiment of the invention in which a separate tip-on panel T is adhesively attached to a front face of a panel D at an area not coincident with a fold line $f_T$ connecting panel D to other panels such as panel E. This card can also be die cut 360° when fully folded such that the peripheral edge of the tip-on panel T is either coincident with peripheral edges of the other panels or overlaps the peripheral edges of the other panels. Consequently, tip-on panel T completely covers panel D and the panels attached thereto, and the fold line or lines are not eliminated when panel T is die cut 360°. In other words, the fold lines do not extend laterally beyond the peripheral edges of tip-on panel T. This fact enhances the frontal appearance of the card. As shown, a portion of a peripheral edge of tip-on panel T may cross over and eliminate a portion $f_{T1}$ of fold line $f_T$ without compromising the support and hinge function of the fold.

Multiple stacked cards of each of the embodiments of the invention may be simultaneously die cut in the folded configuration, whether or not one panel is glued to another. Known card production processes and decorative treatments such as hot-stamping, die-cutting, printing on both sides of the card stock, finishing, embossing, silk screening, bronzing, etc., can be readily incorporated in the card production methods of the present invention.

In a variation on one of the methods of the invention, pre-fold die cutting may be per/brined upon sheet 11 to form, for example, individualized cut-outs 27 in selected panels as also shown in FIG. 1. By cutting such cut-outs prior to folding, the individualized cut-outs 27 can be made unique to selected panels. In another method of making of the invention, the multi-panel card 14 may be cut out (along peripheral edge line 12) prior to formation of fold lines 15 and 16. This method may of course be applied to a stack of a plurality of card stock sheets 11 and allows the peripheral configurations of the panels to differ.

Thus a multiple panel foldable greeting card and method of making is disclosed in which at least one of the panel-connecting fold lines is positioned laterally inward from a free peripheral edge of the card when the card is in a folded configuration so that the card may be die cut 360° around the periphery of the card without cutting off the fold lines. Consequently, the fold lines are concealed by the free peripheral edges of the end panels when the card is fully folded, thereby improving the appearance of the card.

What is claimed is:

1. A foldable card cut from a single sheet of paper stock, the card comprising at least three panels connected along substantially parallel fold lines, two of the at least three panels being end panels, each panel having a substantially non-linear peripheral edge profile, each end panel having a free peripheral edge not connected along a fold line, each panel being foldable substantially flush against adjacent panels, wherein the peripheral edge profile of each panel is substantially similar, and wherein the free peripheral edge of each end panel extends laterally beyond the fold line connecting each end panel and the adjacent panel.

2. The card of claim 1 wherein the fold line connecting a first panel and a second panel intersects the free peripheral edge of a third panel.

3. The card of claim 1 wherein a first panel is attached to second panel at a surface area of contact between the two panels not near the peripheral edge profile of either panel and not coincident with the fold line connecting the two panels.

4. The card of claim 3 wherein at least a portion of the fold line connecting the first and second panels is cut off.

5. The card of claim 1 further comprising more than three panels connected along fold lines.

6. The card of claim 1 wherein the peripheral edge profiles of the panels are substantially aligned when the card is completely folded.

7. The card of claim 1 wherein one of the panels has a unique cut-out portion.

8. The card of claim 1 wherein one of the fold lines is a gap-jumping fold line which passes through a cut-out portion of the peripheral edge profile of the panels connected along the gap-jumping fold line.

9. A foldable card comprising at least three panels connected at edges along fold lines, wherein each panel has a substantially non-linear peripheral edge profile, wherein a surface of a first panel is attached to a face of a second panel at an area not coincident with a fold line, and wherein the fold line connecting edges of the second panel and a third panel does not extend laterally beyond a free peripheral edge of the first panel when the card is in a folded configuration.

10. The card of claim 9 wherein at least a portion of the first panel overlaps at least portions of the fold line connecting the second and third panels.

11. The card of claim 9 wherein the free peripheral edge of the third panel extends at least partially laterally beyond the fold line connecting the first and second panels when the card is in a folded configuration.

12. The card of claim 9 wherein the fold line connecting the first and second panels is cut off.

13. A foldable card comprising at least three panels, each panel having a substantially non-linear peripheral edge profile, wherein a surface of at least a first panel is attached to a face of a second panel at an area not coincident with a fold line, wherein at least the second panel and a third panel are connected along a fold line, wherein the fold line connecting the second and third panels does not extend laterally beyond a free peripheral edge of the first panel when the card is in a folded configuration, and wherein the peripheral edge profile of each panel is substantially similar.

* * * * *